US005879873A

United States Patent [19]

Gourlaouen et al.

[11] Patent Number: 5,879,873

[45] Date of Patent: Mar. 9, 1999

[54] PROCESS OF PREPARING HIGH BROMIDE (100) TABULAR GRAIN EMULSIONS

[75] Inventors: Luc R. Gourlaouen; Pierre-Henri Jezequel, both of Givry, France

[73] Assignee: Eastman Kodak Company, Rochester, N.Y.

[21] Appl. No.: 956,346

[22] Filed: Oct. 23, 1997

[30] Foreign Application Priority Data

Dec. 9, 1996 [FR] France ..... 96 15459

[51] Int. Cl.[6] ..... G03C 1/035; G03C 1/015

[52] U.S. Cl. ..... 430/569; 430/567

[58] Field of Search ..... 430/567, 569

[56] References Cited

U.S. PATENT DOCUMENTS

| | | | |
|---|---|---|---|
| 4,063,951 | 12/1977 | Bogg | 430/367 |
| 4,386,156 | 5/1983 | Mignot | 430/567 |
| 5,565,314 | 10/1996 | Nakatsu et al. | 430/567 |
| 5,652,089 | 7/1997 | Saitou | 430/567 |
| 5,726,006 | 3/1998 | Gourlaouen et al. | 430/567 |

FOREIGN PATENT DOCUMENTS

| | | | |
|---|---|---|---|
| 0 584 644 A2 | 3/1994 | European Pat. Off. | G03C 1/005 |

*Primary Examiner*—Mark F. Huff
*Attorney, Agent, or Firm*—Carl O. Thomas

[57] ABSTRACT

A process of preparing a high bromide {100} tabular grain emulsion is disclosed wherein mean ECD of the tabular grains obtained at the conclusion of ripening is controlled by the use of chloride ion. Specifically, both the concentration of chloride ion introduced before grain nucleation and the proportion of chloride ion and bromide ion present during nucleation are shown to allow control of final mean grain ECD in the fully ripened emulsion.

8 Claims, No Drawings

PROCESS OF PREPARING HIGH BROMIDE (100) TABULAR GRAIN EMULSIONS

FIELD OF THE INVENTION

The invention relates to a process of preparing radiation-sensitive tabular grain emulsions useful photography.

DEFINITION OF TERMS

In referring to grains and emulsions containing two or more halides, the halides are named in order of ascending concentrations.

The term "high bromide" refers to grains and emulsions that contain greater than 50 mole percent bromide, based on silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" refers to a grain having two parallel crystal faces that are clearly larger than an remaining face (hereinafter also referred to as major faces) and an aspect ratio of at least 2.

The term "tabular grain emulsion" refers to an emulsion in which tabular grains account for greater than 50 percent of total grain projected area.

The term "{100} tabular" refers to tabular grains and tabular grain emulsions in which the tabular grains accounting for at least 50 percent of total grain projected area have {100} major faces.

The term "{111} tabular" refers to tabular grains and tabular grain emulsions in which the tabular grains accounting for at least 50 percent of total grain projected area have {111} major faces.

All vAg values reported are in units of millivolts (mV) and represent the potential difference between a Ag° electrode and a Ag/AgCl reference electrode, linked to the dispersing medium within a precipitation vessel through a salt bridge.

*Research Disclosure* is published by Kenneth Mason Publications, Ltd., Dudley House, 12 North St., Emsworth, Hampshire P010 7DQ, England.

BACKGROUND

The overwhelming majority of high bromide tabular grain emulsions are {111} tabular grain emulsions. Usually all of the tabular grains in such emulsions have major faces lying in {111} crystal planes.

Although there are known performance advantages for high bromide {100} tabular grain emulsions, their use has been limited, since, compared to processes for preparing high bromide {111} tabular grain emulsions, their preparation processes are more difficult to control. Specifically, high bromide {100} tabular grains emerge as a result of grain ripening. Attempts to limit mean tabular grain edge length have resorted to terminating grain ripening while a significant proportion of smaller and non-tabular grains remain in the precipitation vessel. This does not represent an efficient use of silver or desirably high yields of high bromide {100} tabular grains. When grain ripening is prematurely terminated, the final emulsions resemble emulsions that are blends of {100} tabular grains and relatively fine grains. Thus, obtaining aim mean grain ECD's while also ripening to completion, thereby eliminating fine grain components, has not been realized.

The following patents have sought to prepare high bromide {100} tabular grain emulsions, although minimum definitional requirements (set out above) have frequently gone unrealized:

Bogg U.S. Pat. No. 5,063,951;

Mignot U.S. Pat. No. 5,386,156;

SUMMARY OF THE INVENTION

In one aspect this invention is directed to a process of preparing a radiation-sensitive tabular grain emulsion in which tabular grains having {100} major faces are comprised of at least 80 mole percent bromide and less than 5 mole percent iodide, based on silver, with any remaining halide being chloride, said process being comprised of the following steps: (a) providing an aqueous dispersing medium and maintaining the dispersing medium at a pH of from 2 to 9 through step (d), (b) prior to introducing silver ion, introducing chloride ion into the dispersing medium in a concentration of from 0.001 to 0.2 mole per mole of silver ion introduced through step (d), (c) forming grain nuclei in the presence of bromide ion and chloride by the addition of bromide ion and silver ion into the dispersing medium while (1) maintaining a stoichiometric excess of silver ion within the dispersing medium and (2) within 200 seconds of initiating step (1) eliminating the stoichiometric excess of silver ion by maintaining the dispersing medium within the vAg range of from 150 to 220 mV, and (d) undertaking grain ripening and growth to obtain the {100} tabular grains.

It has been discovered quite surprisingly that minor amounts of chloride ion introduced into a precipitation vessel can, in combination with the addition of bromide ion, control the mean size of high bromide {100} grains. As demonstrated in the Examples below, by choice of the chloride to total silver proportion and the proportion of chloride to bromide ion, a wide range of mean grain ECD's are available at the conclusion of grain ripening. Thus, it is possible for the first time to select a specific aim mean grain ECD for a high bromide {100} tabular grain emulsion and realize this aim without prematurely terminating ripening, thereby leaving significant portions of seed grains that have not be utilized in the ripening step. The result is an ability to form efficiently high bromide {100} tabular grain emulsions over a wide range of mean grain sizes and with efficient conversion of the total silver present to {100} tabular grains.

PREFERRED EMBODIMENTS

The present invention is directed to a process of preparing radiation-sensitive high bromide {100} tabular grain emulsions. As prepared the emulsion grains contain at least 80 (preferably at least 90) mole percent bromide and less than 5 (preferably from 1 to 3) mole percent iodide, with any remaining halide being chloride. Iodide is not a necessary component of the grains and, when present, is preferably introduced during grain growth following nucleation. Although chloride ion is present during grain nucleation, the much higher solubility of chloride ion as compared to bromide ion, which is also present, allows grains to be formed, if desired, that contain no appreciable quantities of chloride.

The high bromide {100} tabular grains prepared by the process of the invention preferably have average aspect ratios of greater than 5 and account for greater than 50 percent of total grain projected area. Preferably the tabular grains account for at least 70 percent of total grain projected area. The process of the invention is well suited to preparing high bromide {100} tabular grains having mean thickness of less than 0.2 $\mu$m.

The process of the invention can be divided for discussion into basically three steps:

(1) preparing the dispersing medium within the precipitation vessel;

(2) controlling grain nucleation; and (3) undertaking grain ripening and growth to obtain the high bromide {100} tabular grain population sought.

It is, of course, apparent that the same sequence of steps are involved in preparing high bromide {100} tabular grain emulsions by conventional procedures, such as those disclosed, for example, by Mignot U.S. Pat. No. 4,386,156, cited above and here incorporated by reference. The improvement of the present process resides in modification of steps (1) and (2), described in greater detail below.

In the process of the invention the radiation-sensitive high bromide {100} tabular grain emulsion is prepared by the following steps:

(a) providing an aqueous dispersing medium and maintaining the dispersing medium at a pH of from 2 (preferably >3) to 9 through step (d), (b) prior to introducing silver ion, introducing chloride ion into the dispersing medium in a concentration of from 0.001 to 0.2 (preferably 0.02 to 0.1) mole per mole of silver ion introduced through step (d), (c) forming grain nuclei in the presence of bromide ion and chloride by the addition of bromide ion and silver ion into the dispersing medium while (1) maintaining a stoichiometric excess of silver ion within the dispersing medium and (2) within 200 seconds of initiating step (1) eliminating the stoichiometric excess of silver ion by maintaining the dispersing medium within the vAg range of from 150 to 220 mV, and (d) undertaking grain ripening and growth to obtain the {100} tabular grains.

As a specific illustration, high bromide {100} tabular grains with average aspect ratios of greater than 5 can be prepared by means of the following steps:

(a) a nucleation medium is prepared, consisting essentially of an aqueous solution of gelatin;

(b) nucleation is effected at a pH of between 2.0 and 9.0 and a vAg of between 150 to 220 mV with, during at least part of this nucleation, a stoichiometric excess of silver, preferably achieved by maintaining a vAg of greater than 240 mV; and (c) grain ripening and growth.

This method is characterized in that a quantity of chloride ions of between 0.001 and 0.2 and preferably between 0.02 and 0.1 mole per mole of total silver introduced during the entire precipitation is introduced into the dispersing medium before initiating the grain nucleation step. The chloride ions are introduced in the form of soluble salts, for example alkali metal, alkaline earth metal or ammonium chlorides, or in the form of an emulsion with very fine grains (diameter less than 0.1 $\mu$m), for example a Lippmann silver chloride emulsion.

Conventionally, "nucleation" means the step, between the start of introduction of the reagents and the end of introduction of the reagents, in which the silver halide seeds, or nuclei, are precipitated, that is to say during this step a significant part of the silver consumed serves to precipitate new grains, rather than growing the grains already formed. The objective is therefore to form a population of nuclei having given characteristics. To obtain high bromide tabular grains with faces {100}, it is necessary to apply, during at least part of the nucleation, a vAg corresponding to a momentary stoichiometric excess of silver ion. The characteristics of this nucleation technique are as follows:

The formation of the seeds is achieved by simultaneous or alternating double jet, or by consecutive single jets of silver nitrate and then halide.

Before introducing the jets into the precipitation reactor, the latter is furnished with a certain quantity of dispersion medium (aqueous solution of gelatin or equivalent hydrophilic colloid), with the optional addition of a bromide ion and certain agents such as acids, buffer agents, etc. The vAg of the reactor is adjusted to a value of 150 to 220 mV and a pH to a value of 2 to 9 and preferably a pH greater than 3, since it is desired to prevent a degradation of the gelatin, as can occur at a pH of less than 5. The vAg is adjusted by regulation of bromide ion addition, preferably with a solution of alkaline metal bromide and the pH with a dilute aqueous acid without any effect on the pH, such as $HNO_3$. Emulsions with very fine grains, such as Lippmann emulsions, can also be added to the reactor, after commencing nucleation. For precipitating the seeds, jets are used with a concentration of between 1 and 5M, advantageously between 3.5 and 4.5M, with flow rates of approximately 50 to 1000 ml/minute. During at least part of this seed formation step, a stoichiometric excess of silver is produced which is at least momentary, at the start of the nucleation, that is to say for a short period, for example between approximately 0.5 and 200 seconds and advantageously between 10 and 100 seconds. During this period, a vAg of greater than 240 mV is preferably maintained. It is preferred to limit the stiochiometric excess of silver ion by maintaining maximum vAg at less than 400 mV and preferably less than 300 mV.

The temperature is between 30° C. and 75° C. Throughout the nucleation, the content of the reactor is stirred, in the case of a rotary stirrer, at a speed of 500 to 5000 revolutions/minute. The halide composition of the precipitation jets is such that finer grains are obtained comprising at least 80 mole percent and preferably at least 90 mole percent bromide with respect to the quantity of silver, as indicated above. When it is desired to obtain silver chlorobromide grains, chloride is introduced in the halide jet, or at least one separate jet. When the final emulsion contains iodide, the latter is added after the formation of the tabular grains, such as in the form of an addition of potassium iodide after the growth step. The quantity of iodide in the grains at the final stage is in general less than 5 mole percent and preferably between 1 and 3 mole percent, based on silver.

During nucleation, ripening agents can be added, such as thioethers, fine-grain emulsions or various additives such as doping agents, growth modifiers, etc.

As indicated above, the seeds or nuclei are used in the follow step, which is a maturation step. For the maturation step, temperature and stirring conditions are used which are close to those of the previous nucleation step. The vAg is preferably adjusted to a value of between 150 to 220 mV and the pH to a value of 6 to 7.

A conventional growth step for the precipitation of high bromide grains with {100} crystal faces can then be effected, but with vAg preferably maintained in the range of from 150 to 220 mV to minimize thickening of the tabular grains. Typically growth is achieved by the addition of jets, at a constant or accelerated flow rate, of silver nitrate and alkaline metal halides or, again, a fine-grain emulsion of the Lippmann type.

Generally the procedures for preparing conventional high bromide {100} grains, including regular {100} grains (i.e., cubic grains) can be employed for grain growth and all subsequent preparation steps. These features can be selected from among that summarized in *Research Disclosure,* Vol. 389, September 1996, Item 38957:

I. Emulsion grains and their preparation, particularly

C. Precipitation procedures, paragraph (2), which identifies preferred procedures for controlling vAg and pH during precipitation (note particularly Chang U.S. Pat. No. 4,933,170, here incorporated by reference), and paragraph (3);

D. Grain modifying conditions and adjustments, particularly paragraphs (3)–(5), which pertain to dopants; and E. Blends, layers and performance categories. A selection of conventional ripening agents are disclosed in paragraph (2).

After precipitation the emulsions can be washed by conventional procedures, illustrated by *Research Disclosure,* Item 38957, III. Emulsion washing. The removal of soluble salts during precipitation can be practiced as illustrated by *Research Disclosure,* Item 38957, C. Precipitation procedures, particularly Mignot U.S. Pat. No. 4,334,012, here incorporated by reference. The teachings of Mignot '012 to defer peptizer addition until after grain nucleation has at least started can also be employed.

The emulsions contain in addition to the grains a vehicle—specifically, a peptizer present during precipitation and a binder added after precipitation. The emulsions as precipitated contain a hydrophilic colloid peptizer. Typically gelatin and gelatin derivatives, such a phthalated or acetylated gelatin, are employed as gelatio-peptizers. Subsequent to precipitation and, particularly, prior to coating binder is added. The same types of hydrophilic colloids employed as peptizer can also be employed as a binder; however, a still wider range of materials can be employed a binders or extenders. Preferred vehicles and vehicle related materials are described in *Research Disclosure,* Item 38957, II. Vehicles, vehicle extenders, vehicle-like addenda and vehicle related addenda.

Other conventional performance enhancing characteristics can be imparted to the emulsions by the use of chemical and/or spectral sensitizers, antifoggants and/or stabilizers, as well as coating physical property modifying addenda. When the emulsions are employed to form dye images, dye image formers and modifiers can be employed. All of these conventional features are illustrated within *Research Disclosure,* Item 38957.

The emulsions of the invention can be used to form black-and-white (e.g., silver) images (including radiographic images), color negative or color reversal images. Absent intentional modification, the emulsions as precipitated form surface latent images and are normally employed as negative-working emulsions.

The high bromide {100} tabular grains can be modified to form direct positive images by (1) surface fogging the grains after precipitation or (2) sensitizing the surface of the grains and then shelling the grains to create internal latent image sites. In form (1) the grains are preferably also internally doped to trap photogenerated electrons, allowing photogenerated holes to migrate to the surface of the grains to bleach surface fog. Group VIII metals, particularly Ir, are preferred dopants. In form (2) highest speeds are realized in which core and shell sensitizations are balanced, as illustrated by *Research Disclosure,* Item 38957, Section D. Grain modifying conditions and adjustments, paragraph (2), particularly Evans U.S. Pat. No. 3,761,276 and Atwell et al U.S. Pat. No. 4,035,185, the disclosures of which are here incorporated by reference.

EXAMPLES

The invention can be better appreciated by reference to the following specific embodiments:

EXAMPLE 1

In a precipitation reactor, 15 L of a 34.7 g/L solution of bone gelatin was introduced, and pH was adjusted to 3.0 with 4N $HNO_3$. To this solution, stirred at 1000 revolutions/min and maintained at 70° C., there were added simultaneously over 60 seconds a 4.05M solution of $AgNO_3$ and a 4.00M solution of NaBr. One mole of AgBr was precipitated in total. Ripening of this emulsion was effected by adjusting the pH to 6.5 with 2N NaOH and the VAg to +173.8 mV with KBr (44 g/L solution). The emulsion was maintained at 70° C. for 210 minutes, with stirring at 2000 revolutions/min.

A silver bromide {100} tabular grain emulsion was obtained, having the following mean grain characteristics:

Length of edge: 1.8 $\mu$m

Thickness: 0.10 $\mu$m

EXAMPLES 2–7

The process of Example 1 was repeated, except that, after adjusting the initial pH in the reactor to 3.0, different quantities of NaCl were introduced in accordance, as set out in Table I below.

TABLE I

| Example | Quantity of NaCl (moles) | Length of edge ($\mu$m) |
|---|---|---|
| Control (no Cl) | 0 | 1.8 |
| 2 | 0.005 | 0.750 |
| 3 | 0.010 | 0.550 |
| 4 | 0.025 | 0.457 |
| 5 | 0.050 | 0.300 |
| 6 | 0.10 | 0.210 |
| 7 | 0.20 | 0.200 |

The mean thickness of the tabular grains was in each instance approximately 0.10 $\mu$m.

From Table I it is apparent that small amounts of chloride ion in the precipitation vessel prior to grain nucleation can control mean grain edge length without adversely affecting mean grain thickness.

EXAMPLE 8

Fifteen liters of a 3.47 g/L solution of bone gelatin was introduced into a precipitation reactor. The pH was adjusted to 3.0 with $HNO_3$ 4N and the VAg to +173.8 mV with an NaBr solution. To this solution, stirred at 1000 revolutions/min and maintained at 70° C., there were added simultaneously over 60 seconds a 4.05M solution of $AgNO_3$ and a 4.00M solution of NaBr. A total of 1 mole of AgBr was precipitated. Ripening of the emulsion is effected whilst adjusting the pH to 6.5 with NaOH, the VAg to +173.8 mV with NaBr and the temperature with stirring at 2000 revolutions/min.

A silver bromide {100} tabular grain emulsion was obtained, having the following mean grain characteristics:

Length of edge: 1.8 $\mu$m

Thickness: 0.12 $\mu$m

EXAMPLES 9–14

The process of Example 8 was repeated, except for replacing the NaBr solution introduced into the reactor before nucleation, with a mixed NaCl/NaBr solution in which the chloride represents different molar percentages of the total halides, according to the information in Table II below. The VAg is maintained at a value of 173.8 mV.

The results are set out in Table II below:

TABLE II

| Example | Cl mole/Ag mole precipitated | Length of edge ($\mu$m) |
|---|---|---|
| 8 | 0 | 1.8 |
| 9 | 0,0145 | 1.626 |
| 10 | 0,058 | 1.43 |
| 11 | 0,0637 | 0.99 |
| 12 | 0,0715 | 0.791 |
| 13 | 0,0785 | 0.635 |
| 14 | 0,0811 | 0.34 |

The mean thickness of the tabular grains was between 0.11 and 0.12 $\mu$m in each example.

From these examples it is apparent that mixtures of chloride ion and bromide ion in all proportions are effective to produce high bromide {100} tabular grain emulsions. The larger the proportion of total halides present in the precipitation vessel during nucleation that are chloride ions, the lower is mean grain edge length and, as a result, the average aspect ratio, although grain thicknesses is unaffected.

The invention has been described in detail with particular reference to certain preferred embodiments thereof, but it will be understood that variations and modifications can be effected within the spirit and scope of the invention.

What is claimed is:

1. A process of preparing a radiation-sensitive tabular grain emulsion in which tabular grains having {100} major faces are comprised of at least 80 mole percent bromide and less than 5 mole percent iodide, based on silver, with any remaining halide being chloride, said process being comprised of the following steps:

(a) providing an aqueous dispersing medium and maintaining the dispersing medium at a pH of from 2 to 9 through step (d), (b) introducing chloride ion into the dispersing medium in a concentration of from 0.001 to 0.2 mole per mole of silver ion introduced through step (d), (c) forming grain nuclei in the presence of bromide ion and chloride by the addition of bromide ion and silver ion into the dispersing medium while (1) maintaining a stoichiometric excess of silver ion within the dispersing medium and (2) within 200 seconds of initiating step (1) eliminating the stoichiometric excess of silver ion by maintaining the dispersing medium within the vAg range of from 150 to 220 mV, and (d) undertaking grain ripening and growth to obtain the {100} tabular grains.

2. A process according to claim 1 wherein the concentration of chloride ion in step (b) is in the range of from 0.1 to 0.2 mole per mole of silver ion introduced through step (d).

3. A process according to claim 1 wherein bromide ion is introduced as the sole halide ion in step (c), resulting in the formation of silver bromide grain nuclei.

4. A process according to claim 1 wherein additional chloride ion is introduced during step (c), resulting in the formation of silver chlorobromide grain nuclei.

5. A process according to claim 1 where pH in step (a) is greater than 3.

6. A process according to claim 1 wherein vAg during part (1) of step (c) is greater than 240 mV.

7. A process according to claim 6 wherein vAg during part (1) of step (c) is limited to less than 400 mV.

8. A process according to claim 1 wherein iodide ion is introduced during step (d).

* * * * *